United States Patent [19]

Fischhaber et al.

[11] Patent Number: 4,572,574

[45] Date of Patent: Feb. 25, 1986

[54] COLLAPSIBLE TABLE STRUCTURE WITH INTERCONNECTED BENCH SEATS

[76] Inventors: Nikolaus Fischhaber, Wackersberger Strasse 42; Johann Ronge, Scharfreiter Strasse 20 A, both of 8172 Lenggries, Fed. Rep. of Germany

[21] Appl. No.: 709,710

[22] Filed: Mar. 8, 1985

[30] Foreign Application Priority Data

May 9, 1984 [DE] Fed. Rep. of Germany ..... 8413990

[51] Int. Cl.[4] ..... A47B 3/14

[52] U.S. Cl. ..... 297/159; 108/100

[58] Field of Search ..... 297/159, 157, 440; 108/117, 132, 131, 129, 127, 100, 99

[56] References Cited

U.S. PATENT DOCUMENTS

| | | | |
|---|---|---|---|
| 2,662,583 | 12/1953 | Coe | 297/157 |
| 2,690,210 | 9/1954 | Holick | 297/159 |
| 2,992,043 | 7/1961 | Nelson | 297/159 |
| 3,273,936 | 9/1966 | Deavers | 297/159 |
| 4,060,275 | 11/1977 | Hansen . | |

FOREIGN PATENT DOCUMENTS 1125391 10/1956 France .

*Primary Examiner*—Francis K. Zugel

*Attorney, Agent, or Firm*—Watson, Cole, Grindle & Watson

[57] ABSTRACT

A collapsible table structure with interconnected bench seats comprises a top assembly that includes a table top and cross braces thereunder having slideways; a seat assembly that includes two beam members and two bench seats, the beam members being located under the cross braces of the top assembly and including retainer notches therein; and two leg assemblies that are associated with opposite sides of the table top, each leg assembly including two leg members, each leg member having an upper mounting bolt which extends through a corresponding slideway and a lower mounting bolt which extends through the associated beam member, as well as a pivotable support arm which has a free end that is positionable in a corresponding retainer notch in the associated beam member when the table structure is set up for use.

5 Claims, 3 Drawing Figures

COLLAPSIBLE TABLE STRUCTURE WITH INTERCONNECTED BENCH SEATS

BACKGROUND OF THE INVENTION

The present invention relates to table structures which have bench seats interconnected thereto.

Table structures which include interconnected bench seats are relatively common items of furniture. When built for outdoor use, they are commonly called picnic tables. However, because these table structures are generally quite large in size, they must usually be disassembled for long-term storage. Unfortunately, the breakdown of such a table structure can be very time consuming and difficult, and once disassembled the bolts that are used to interconnect the various elements of the table structures thereof can be easily misplaced.

SUMMARY OF THE INVENTION

It is an object of the present invention to provide a table structure having interconnected bench seats that can be easily set up for use and easily collapsed into a compact unit for storage.

According to the present invention, the table structure with interconnected bench seats includes a top assembly which includes a table top and cross braces thereunder, the cross braces including slideways therein; a seat assembly located beneath the top assembly, the seat assembly including beam members and bench seats connected between the opposite ends of the beam members; and two leg assemblies, each leg assembly including two leg members which each include an upper mounting bolt at its upper end that can slide within a slideway of the associated cross brace and a lower support bolt that is connected to the associated beam member. Each leg member also includes a support arm pivotally connected thereto between its upper mounting bolt and its lower mounting bolt, the free end of the support arm being positionable in a retainer means in the associated beam member. When set up for use, the top assembly can be moved away from the seat assembly and the leg assemblies suitably pivoted with respect to the beam members of the seat assembly such that they will become suitably oriented to support the top assembly and the seat assembly above the ground. The support arms on the leg members are then positioned in the retainer means in the beam members to fixedly hold the assemblies with respect to one another. When collapsed for storage, the support arms are moved away from the retainer means and the leg assemblies are then pivoted with respect to the beam members of the seat assembly such that the top assembly will be moved toward the seat assembly. Ultimately, the top assembly, the seat assembly and the leg assemblies will be repositioned to form a compact, generally flat unit.

The invention will now be better understood by reference to the attached drawings, taken in conjunction with the following discussion.

DETAILED DESCRIPTION OF THE PREFERRED EMBODIMENT

Figure 1:
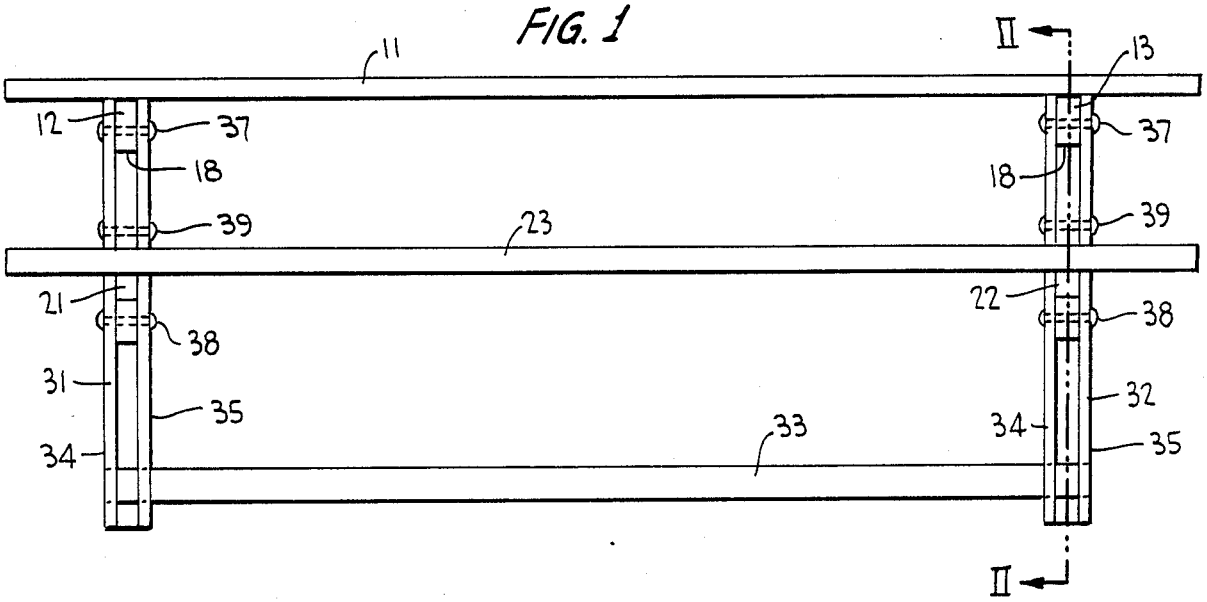
FIG. 1 shows an elevational side view of one embodiment of the inventive table structure with interconnected bench seats when set up for use.
Figure 2:
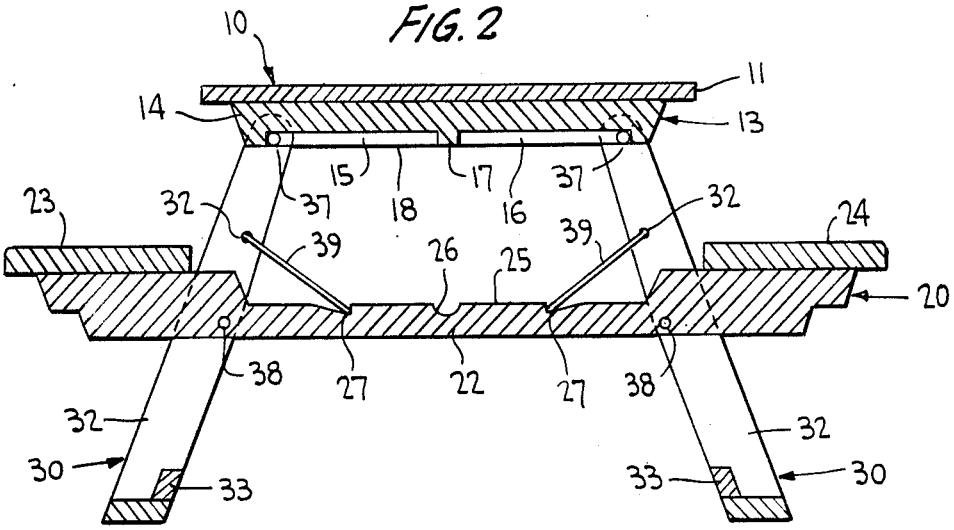
FIG. 2 shows a sectional view of the inventive table structure with interconnected bench seats as seen along line II—II of FIG. 1.
Figure 3:
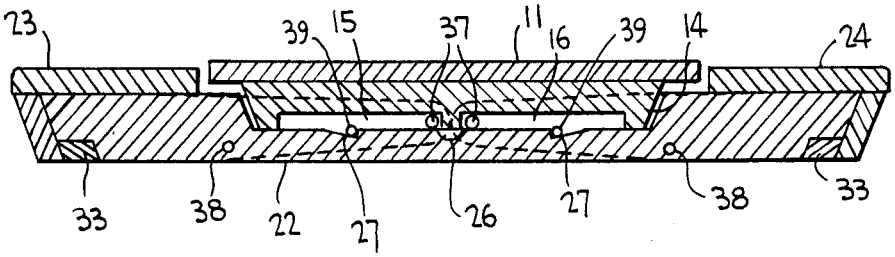
FIG. 3 shows a sectional view similar to that shown in FIG. 2 but wherein the inventive table structure with interconnected bench seats has been collapsed for storage.

As can be best seen in FIGS. 1 and 2, the inventive table structure with interconnected bench seats includes a top assembly 10, a seat assembly 20 and two leg assemblies 30. When the table structure with interconnected bench seats is set up for use, the assemblies will be positioned relative to one another as shown in FIGS. 1 and 2, whereas when collapsed for storage, they will be positioned as indicated in FIG. 3.

The top assembly 10 generally includes a rectangular table top 11 and two identical cross braces 12 and 13 which are located beneath the table top 11 and extend transversely thereof near its opposite ends. Each cross brace is formed of an elongated member 14 which has an upper side that is in supporting contact with the table top 11 and a lower side that includes two collinear grooves of equal length, the two grooves being separated by a stop portion 17. Each cross brace also includes a flat bar 18 which is attached to the lower side of the elongated member 14, including top portion 17, so as to enclose the lower sides of the grooves, thus providing two collinear slideways 15 and 16 in the cross brace. The purpose of these two slideways in each cross brace will become apparent below.

The seat assembly 20, which will be generally rectangular in configuration when seen from above, includes two identical beam members 21 and 22 which extend transversely of the table top 11 and are respectively positioned in parallel with and below the associated cross braces 12, 13, and two bench seats 23 and 24 which extend longitudinally of the table top 11 and are mounted at their opposite ends on the corresponding ends of the beam members 21,22. The beam members 21,22 are longer than the cross braces 12,13, and indeed extend beyond the opposite sides of the table top 11, such that the bench seats mounted at their ends are positioned beyond the sides of the table top 11, i.e., when viewed from above. Each beam member 21,22 has an elongated channel 25 extending downwardly therein which has a shape and length which corresponds to the shape and length of the associated cross brace 12,13 thereabove. In addition, each beam 21,22 includes a depression 26 extending downwardly therein at about midway along its length (located below the stop portion 17 of the associated cross brace thereabove) and two retainer notches 27 extending downwardly therein on opposite sides of the despression 26 (still within the channel 25). The purpose of these two retainer notches in each beam member will become apparent below.

The two leg assemblies 30, each of which is associated with a respective opposite side of the table top 11, each includes two leg members 31 and 32 which have upper and lower ends, as well as a connection bar 33 which extends between the leg members near their lower ends. The connection bar 33 is of such a length that the leg members 31,32 are spaced apart a distance equal to the spacing between the cross braces 12,13 and the beam members 21,22. In addition, each of the leg members 31,32 is composed of two elongated, flat plate elements 34 and 35 which are spaced apart a distance slightly greater than the widths of either the cross braces 12,13 or the beam members 21,22. The plate elements 34,35 of each leg member are in fact positioned such that the associated cross brace 12,13 and beam 21,22 extends therebetween. An upper mounting bolt 37 extends through the two plate elements of each leg member near its upper end so as to extend through the corresponding slideway 15,16 in the associated cross brace 12,13 and a lower mounting bolt 38 extends through the two plate elements of each leg member along its length so as to extend through the associated beam member 21,22 at respective points outwardly of the channel 25 therein. The upper mounting bolts 37 will be slidingly movable along the corresponding slideway 15,16 in the associated cross brace 12,13. The leg members 31,32 and the beam members 21,22 will be pivotable around the lower mounting bolts 38. Each leg member also includes a support arm 39 which is pivotally connected through the two plate elements thereof at a point between the upper and lower mounting bolts 38,37, the support arm being of such a length that its free end can be positioned in a corresponding retainer notch 27 in the associated beam member 21,22 to maintain the orientation of associated leg member with respect to the beam member extending therethrough.

When the collapsible table with interconnected bench seats is set up for use, the top assembly 10 is moved away from the seat assembly 20 and the leg members of each leg assembly 30 are rotated about the associated beam members, i.e., at the lower mounting bolts 37, such that their upper mounting bolts 37 will slide along the slideway 15,16 of the cross brace 12,13 in which it extends, i.e., toward the outer ends thereof. At this point the leg members 31 and 32 will be capable of supporting the table assembly 10 above the seat assembly 20. Then the free ends of the support arms 39 are positioned within their associated retainer notches 27 in the beam members 21,22. The table structure with bench seats will, when properly positioned on the ground, appear a shown in FIGS. 1 and 2. When collapsed for storage, the free ends of the support arms 39 are moved out of the retainer notches 27 and the leg members 31,32 of each leg assembly 30 are rotated with respect to the associated beam members, such that their upper mounting bolts 38 will slide along the slideways 15,16 of the cross braces 12,13 in which they extend, i.e., toward the inner ends thereof, such that the table assembly 10 will move toward the seat assembly 20. In its final collapsed form, the top assembly 10, the seat assembly 20 and the two leg asemblies 30 will be repositioned to form a compact, generally flat unit, i.e., as indicated in FIG. 3.

While a preferred embodiment of the invention has been described in detail, it is obvious that variations can be made therein and still fall within the scope of the appended claims.

I claim:

1. A collapsible table structure with interconnected bench seats which comprises a table assembly, said table assembly including a generally rectangular table top and two cross braces positioned transversely thereunder for supporting said table top, each cross brace including two collinear slideways therein;

a seat assembly, said seat assembly including two beam members which are transversely positioned with respect to said table top and two bench seats which are longitudinally positioned relative to said table top and which are mounted on corresponding ends of said beam members; each beam member including two retainer means therein along its length, and two pair of leg assemblies, each leg assembly of one pair being associated with an opposite side of said table top, each leg assembly including two leg members and a connection bar connected therebetween, each leg member including (1) an upper mounting bolt located at its upper end, said upper mounting bolt slidingly extending within one of the slideways of the associated cross brace, (2) a lower mounting bolt located along its length, said lower mounting bolt extending through an associated beam member, and (3) a pivoting support arm located between said upper and lower mounting bolts, said pivoting support arm having a free end, said pivoting support arm being capable, when said table structure with interconnected bench seats is set up for use, of being oriented so that its free end connects with a corresponding retainer means, and, when said table structure with inter-connected bench seats is collapsed for storage, of being reoriented so that its free end is dissociated with its corresponding retainer means, said leg assemblies, said seat assembly and said table assembly becoming repositionable relative to one another to form a compact, generally flat unit.

2. The collapsible table structure with interconnected bench seats as defined in claim 1, wherein said beam members are respectively positioned in parallel with and below the cross braces, and wherein each beam member includes a channel extending downwardly therein, each channel having a shape and length which corresponds to the shape and length of the cross brace thereabove.

3. The collapsible table structure with interconnected bench seats as defined in claim 2, wherein said two retainer means in each beam member comprise two retainer notches extending into each beam member along the channel extending downwardly therein.

4. The collapsible table structure with interconnected bench seat as defined in claim 1, wherein each leg member of each leg assembly is composed of two elongated flat plates, wherein the flat plates of each leg member are spaced apart a distance greater than the width of either the cross brace of the beam member associated therewith, wherein the associated cross brace and beam member extends between the flat plates of each leg member, wherein the upper mounting bolt of each leg member extends through each plate element thereof and through the corresponding slideway in the associated cross brace and wherein the lower mounting bolt of each leg member extends through each plate element thereof and through the beam member extending therebetween.

5. The collapsible table structure with interconnected bench seats as defined in claim 1, wherein said beam members are sufficiently long that the bench seats mounted on the opposite ends thereof are located beyond the respective sides of said table top.

* * * * *